United States Patent [19]

Gunn

[11] B 3,995,530

[45] Dec. 7, 1976

[54] SHAKING MACHINE

[76] Inventor: Robert D. Gunn, 1471 Akins Road, Broadview Heights, Ohio 44141

[22] Filed: Oct. 29, 1973

[21] Appl. No.: 410,694

[44] Published under the second Trial Voluntary Protest Program on March 23, 1976 as document No. B 410,694.

[52] U.S. Cl. ..... 91/40; 60/370; 91/231; 91/470; 259/DIG. 43

[51] Int. Cl.[2] ..... F15B 21/02

[58] Field of Search ..... 91/35, 36, 39, 40, 467, 91/230, 231, 470; 259/72, DIG. 43; 60/370, 407; 137/624.13, 624.15

[56] References Cited

UNITED STATES PATENTS

| | | | |
|---|---|---|---|
| 1,006,228 | 10/1911 | Kirkus | 91/39 X |
| 1,080,884 | 12/1913 | Birchett | 91/467 X |
| 1,503,922 | 8/1924 | Slater | 60/370 |
| 2,475,313 | 7/1949 | Davis | 91/40 X |
| 2,773,482 | 12/1956 | Dickie | 121/20 |
| 2,992,636 | 7/1961 | Sampietro | 91/39 X |
| 3,023,738 | 3/1962 | Burgess, Jr. | 121/17 |
| 3,028,050 | 4/1962 | Nelson | 137/624.15 X |
| 3,215,042 | 11/1965 | Holley, Jr. | 91/36 |
| 3,237,641 | 3/1966 | Audemar | 91/40 X |
| 3,333,894 | 8/1967 | Frellsen | 91/40 X |
| 3,372,621 | 3/1968 | Colosimo | 91/36 |
| 3,399,698 | 9/1968 | Bentley | 137/624.15 |
| 3,514,227 | 5/1970 | Rupp | 60/370 X |
| 3,616,979 | 11/1971 | Titcomb | 91/40 X |

FOREIGN PATENTS OR APPLICATIONS

| | | | |
|---|---|---|---|
| 118,770 | 8/1958 | U.S.S.R. | 259/DIG. 43 |

*Primary Examiner*—Martin P. Schwadron
*Assistant Examiner*—Abraham Hershkovitz
*Attorney, Agent, or Firm*—Harold S. Meyer

[57] ABSTRACT

A shaking machine for shaking core sand out of hollow castings includes a pair of coaxial cylinders containing pistons with piston rods arranged to grip a casting, and a rotating vane air valve for supplying compressed air alternately to each of the two cylinders.

9 Claims, 5 Drawing Figures

SHAKING MACHINE

BACKGROUND OF THE INVENTION

Shaking machines, or vibrating machines, have been widely used for many purposes, especially in foundries where they find use in consolidating molding sand in the foundry flasks and also in loosening and removing core sand from hollow castings.

Such machines have generally consisted of a pneumatic hammer acting on the article which is to be shaken or its support. Such shaking machines, while sometimes extremely effective, produce deafening noises and troublesome vibrations and are not always effective for their intended purposes. Moreover, the hammering action causes more or less rapid destruction resulting in considerable maintenance and renewal to keep the machines in operation.

Other types of machines for producing vibration solely by reversible fluid impulses are known but are complex in structure, involving energy losses and wear in moving parts and have accordingly been proposed primarily for investigating effects of vibration rather than for commercial use in manufacturing operations.

An object of this invention, accordingly, is to produce a simple and reliable machine for producing intense and effective vibration without troublesome noise and with only a small consumption of energy. A specific object is to provide a machine for rapid, effective and economical loosening and removal of core sand from hollow castings.

SUMMARY OF THE INVENTION

The vibrating machine of this invention consists of a doubleacting floating piston, or a pair of single-acting pistons arranged to engage one another so as to move in unison, with compressed air supplied alternately to the two faces of the unitary or divided floating piston.

The alternating supply of compressed air is established through a simple rotary valve consisting essentially of a vane extending diametrically across a cylindrical valve chamber having four openings at right angles to one another. Compressed air is supplied through one opening and exhausted through a diametrically opposite opening. The other two openings are connected respectively to the ends of the cylinder or pair of cylinders containing the unitary or divided floating piston.

Since compressed air is the source of energy for the vibration, it is conveniently used also for rotation of the vane of the rotary valve by coupling the vane to a conventional high-speed air motor. The compressed air is conveniently supplied simultaneously to the actual vibrating unitary or divided floating piston and also to the air motor through a single shut-off valve.

In operation of the machine, the vane of the rotary valve during one-fourth of its revolution establishes communication from the compressed air supply to one piston face and discharges compressed air from the opposing piston face. During the second one-fourth of its revolution, the vane, after passing a pair of openings, reverses the operation, permitting exhaust from the first piston face and supply of compressed air to the other one. The same reversal occurs during the third and fourth quadrant of revolution of the vane so that two complete cycles of vibration occur for every complete revolution of the rotary valve.

In a preferred form of the invention, two identical cylinders aligned with each other contain pistons on piston rods at the ends of the cylinders which face one another, so that when air pressure is applied to the pistons the rods will either engage one another or will grip an object placed between them. When the vane of the rotary valve commences rotation, the air pressure against one piston is increased while that against the other is reduced, and the pressures are rapidly reversed so that the pair of pistons and the object gripped by their respective piston rods will undergo rapid vibration.

If the object gripped by the piston rods is a hollow casting still containing core sand, the intensity and frequency of vibration can easily be made such as to loosen the caked core sand. The loose sand will then pour out almost as though it were a fluid.

The extremely low inertia and consequent rapid stop and start of the air motor, together with the very low inertia of the vane of the valve and its almost complete absence of friction, result in almost immediate start and stop when the air is turned on and off and results in a very desirable and effective mode of vibration at a low and tolerable noise level.

THE DRAWINGS

DETAILED DESCRIPTION

Figure 1:
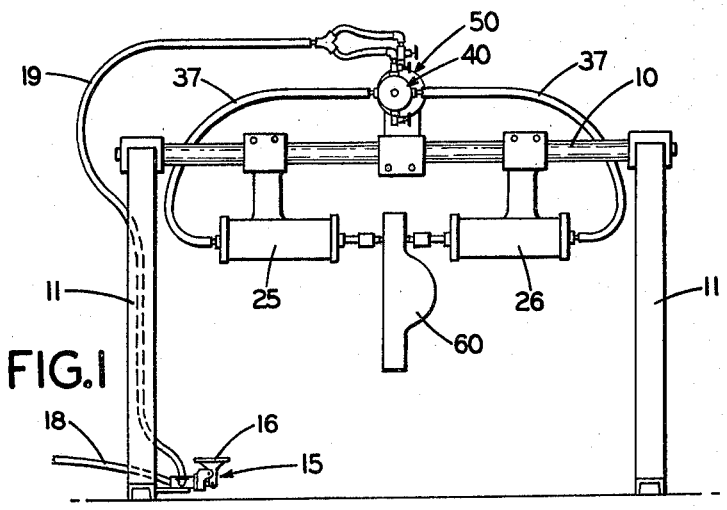
FIG. 1 is a side view of a shaking machine of this invention.
Figure 5:
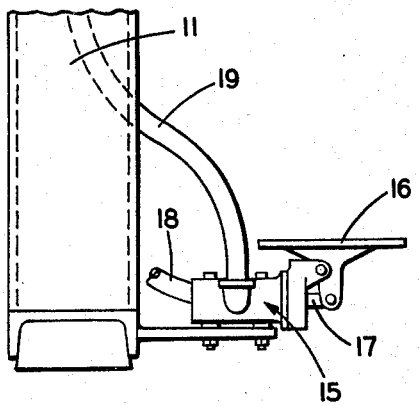
FIG. 5 is a view on an enlarged scale of a pedal control valve.

Referring to FIG. 1, a typical shaking machine may be mounted on a horizontal bar 10 supported on a pair of A-frames 11, or other suitable framing, with the actual shaking mechanism suspended from the bar 10. An on-off air supply valve is provided, such as the pedal-operated valve 15, consisting of a pedal 16, which can be tilted either forward or backward, connected to a plunger 17, which either obstructs or clears and air passage from a supply hose 18 to a machine feed hose 19.

Suspended from the bar 10 are a pair of single-action air cylinders 25 and 26, which are coaxial and are clamped on the bar 10 so that they can be moved toward or away from each other to accommodate different sizes of work. Each of the cylinders 25 and 26 contains a piston 27 connected to a piston rod 28 protruding from the ends of the cylinders which face toward each other. Each rod 28 is suitably provided with a coupling 29 holding a work-gripping tip 30, which is easily interchangeable for other kinds and shapes of tips and which may be roughened as by knurling or may have a special shape to engage a particular kind of work. Preferably, a coil spring 31 will exert a nearly constant small force against each piston 27 in a direction separating the tips 30.

Each of the cylinders 25 and 26 is connected by a conduit, such as air hose 37, to one of the opposing outlets 35 and 36 of the rotary valve 40. The rotary valve 40 is a simple cylindrical chamber divided into two spaces 41 and 42 by a diametrical vane 43. The rotary valve has an air inlet 45 and a diametrically opposite air exhaust 46, each of which is preferably provided with a needle valve or other means for adjusting the rate of air flow. The outlets 35 and 36 are spaced at right angles to the air inlet 45 and air exhaust 46.

Figure 2:
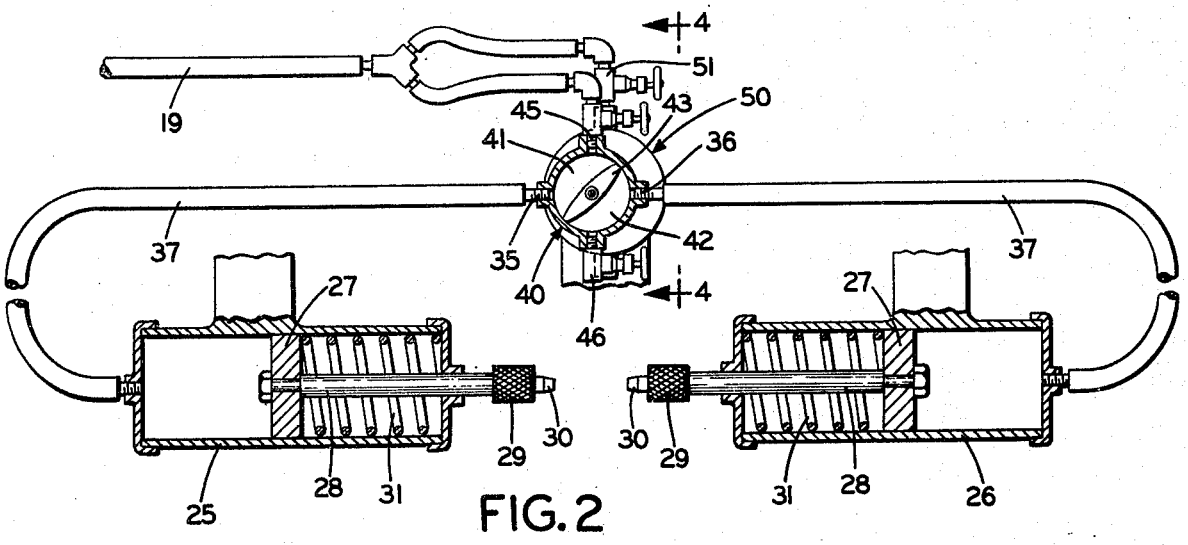
FIG. 2 is a view partly in section on an enlarged scale showing the internal mechanism.

The consequence is that the vane 43 will generally be in a position such as to provide a semi-cylindrical space 41 through which the air supply will communicate with one cylinder, which in the position shown in FIG. 2 will be cylinder 25, and the other semi-cylindrical space 42 will provide communication of the other cylinder 26 to the atmosphere through the air exhaust opening 46. After a one-quarter revolution of the vane 43 of the rotary valve 40, the situation will be reversed and compressed air will flow into cylinder 26 and out of cylinder 25.

The vane 43 is on a common shaft with the rotating parts of a conventional air motor 50, which is supplied with compressed air through a branch of the compressed air feed hose 19 and preferably with a needle valve 51, or other means for adjusting the speed of the motor.

In operation of this machine, when the pedal valve 15 is in the "off" position, the springs 31 will separate the gripping tips 30 at the ends of the piston rods 28. A work piece 60 which is to be shaken is then held between the tips 30, and the pedal valve 15 is shifted to the "on" position, which admits air simultaneously to the rotary valve 40 and to the air motor 50. The inertia of the air motor and of the vane 43 of the rotary valve 40 are so low that the rotation of vane 43 immediately admits rapid puffs of air alternately into cylinders 25 and 26 causing the pistons 27 to move toward one another so that the tips 30 on the piston rods 28 will engage the work piece 60 and grip it firmly. In the intervals between admission of the puffs of compressed air, each of the two cylinders 25 and 26 will be connected alternately to the air exhaust 46 for discharge of a substantial part of the previously-admitted compressed air.

Thus, while cylinder 25 is at maximum pressure, cylinder 26 will be at minimum pressure, and vice versa, which will result in to-and-fro motion of the pistons 27, piston rods 28, tips 30, and work piece 60, in synchronism with one-half revolutions of the vane 43. This vibratory motion will have a high frequency double that of the number of revolutions of the air motor 50 and vane 43 coupled to it, together with an amplitude of sufficient magnitude to produce intense inertia forces.

In this operation, it is desirable that the work piece be firmly held between the tips 30, which can be assured by adjustment of the air exhaust valve 46 to provide a suitable minimum pressure in each of the two cylinders 25 and 26, while the intensity of vibration can be altered by adjusting the air inlet valve 45. Moreover, the motor speed, which influences both frequency and intensity of vibration, can be adjusted by valve 51.

This shaking machine is both extremely simple in construction and convenient in operation. The operator has his hands free to place and remove the work piece 60, while starting and stopping the shaking operation with the pedal valve 15. The work-gripping tips 30 are automatically retracted so as to release the work piece when the operation is terminated by shutting off air with pedal valve 15, and automatically advanced to grip the next work piece and immediately to subject it to intense vibration when the position of the pedal valve 15 is reversed.

The character of the vibration is such as to be extremely effective for such purposes as loosening of caked core sand inside of hollow castings so that it can be poured out. At the same time, it is surprisingly low in noise level and in the kind of vibrations which are transmitted to its surroundings.

Figure 3:
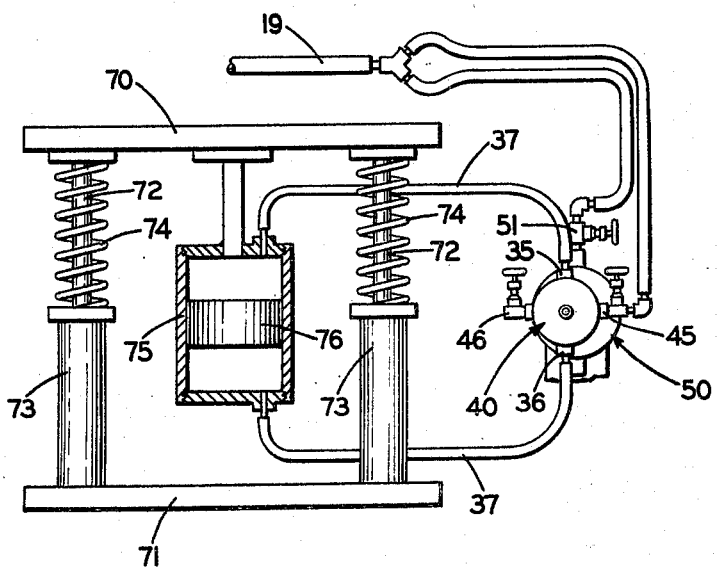
FIG. 3 is a partly diagramatic view of an alternative embodiment.
Figure 4:
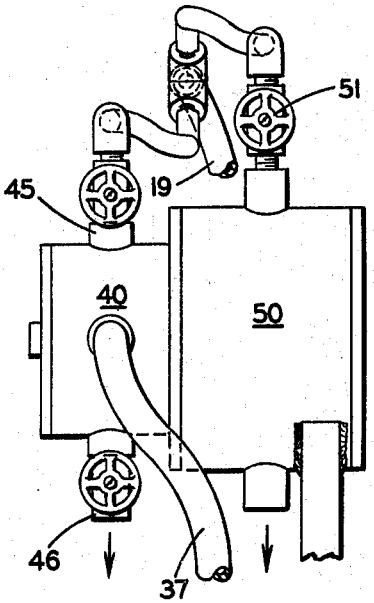
FIG. 4 is a view on an enlarged scale illustrating the coupling of an air motor to the rotary valve.

In the foregoing description, a work piece is engaged by the pressure of a pair of pistons which then operate in unison to vibrate the work piece by reciprocating motion relative to the cylinders and frame of the machine. As is generally the case, exactly the same principle can be used with reversal of parts to bring about a similar vibration of cylinders with respect to a massive piston as is illustrated in FIG. 3.

In this embodiment, a table 70 is freely supported on a base 71 by legs 72 slidable in rigid tubes 73 with compression springs 74 holding the table 70 approximately at a predetermined level. Firmly attached to the table 70 is a doubleacting cylinder 75 containing a massive floating piston 76 and with the two ends of the cylinder 75 connected by flexible hose to a rotary valve 40 of the type described above.

In this embodiment, as in the previous one, the rotation of the vane in the rotary valve 40 admits and exhausts air in rapid alternation in the two air spaces on either side of the faces of the floating piston 76. With suitable choice of the mass of floating piston 76 and of the aggregate mass of the table 70, legs 72 and cylinder 75, the floating piston 76 can be caused to vibrate at twice the speed of rotation of the vane in the rotary valve 40, with respect to the table, legs and cylinder as just mentioned; or, to put it differently, the table and associated parts can be caused to vibrate with respect to the floating piston with amplitude of vibration of the respective halves of the vibratory system in inverse proportion to their respective masses.

Thus, if the mass of floating piston 76 is the same as the mass of table 70, legs 72 and cylinder 75, their amplitude of vibration with respect to stationary objects will be approximately equal and opposite, whereas if the mass of the floating piston 76 is one-half of the aggregate mass of the other vibrating parts, the amplitude of vibration of the piston will be twice that of the table and its connected parts. Since the total amplitude of motion is rather small at the preferred high frequency of vibration, with effectiveness of the shaking or vibration dependent on intensity at a high frequency rather than on high amplitude at a low frequency, it is not necessary to make provision for more than a small total distance of relative motion.

The shaking machine of this invention can be used for a wide variety of purposes, where intense motion with small amplitudes is desirable, and will take different forms to suit different needs and fit different objects or devices which require this kind of vibratory shaking. The objects may be held or clamped by suitable accessories, or if the accelerations are not too high they may simply rest on one of the moving parts such as table 70 in the embodiment of FIG. 3.

This small amplitude, high intensity shaking or vibration is especially useful for inducing flow of pulverulent or granular material into or out of internal spaces, as is required particularly for molding sand in foundries, both in forming sand molds (or cores) and in removing the same after the casting has solidified.

If it should be desirable to subject an object to rapid oscillatory vibration rather than linear vibration, the circular pistons in circular cylinders illustrated in the drawings can be replaced by an oscillating vane, one edge of which is pivoted in a suitable housing and the opposite edge of which can oscillate with a close clearance in an enclosed space which is thereby divided into two closed chambers functioning as "cylinders". When the two chambers are connected to the outlets 35 and 36 of a rotary valve 40, the supply of compressed air alternately in rapid succession to the two chambers, the vane will undergo rapid oscillatory vibration, along with any object fastened to or held by the oscillating vane. Alternatively, the housing can be caused to undergo oscillatory vibration with respect to a sufficiently massive swinging internal vane.

I claim:

1. A shaking machine comprising:

a rotary valve having a circular valve chamber in which a valve element can rotate, an air inlet and an air exhaust in the circular wall of the valve chamber and a pair of outlets in other locations of the circular wall, a source of compressed air connected to the air inlet, a rotating valve element separating the air inlet from one outlet at the same position in which it separates the air exhaust from the other outlet, power means for continuous rotation of the valve element, a pair of conduits, each connected to a different one of the air outlets, a pair of coaxial cylinders each closed at the end most distant from the other cylinder, and each communicating with a different one of the conduits, and a pair of piston faces, each slidable in one cylinder and biased toward the other when compressed air is admitted to the respective cylinder, for motion in unison when a solid movable structure is interposed between the piston faces.

2. A shaking machine as in claim 1, in which the cylinders are spaced, the piston faces are connected to separate piston rods, and a solid movable structure is interposed between the piston rods.

3. A shaking machine as in claim 2, in which the piston rods terminate in work gripping tips for holding a solid movable structure to be shaken.

4. A shaking machine as in claim 3, in which the piston faces are urged apart by springs.

5. A shaking machine as in claim 4, in which the valve chamber is cylindrical and the rotating valve element is a vane dividing the valve chamber into semicylindrical spaces.

6. A shaking machine as in claim 5, in which the rotating vane is driven by an air motor and in which a single air supply valve supplies air both to the cylinders and to the air motor.

7. A shaking machine as in claim 6, including means to adjust the rate of flow of air to the rotating valve.

8. A shaking machine as in claim 7, including means to adjust the rate of exhaust of air from the rotating valve.

9. A shaking machine as in claim 1, in which the rotating valve element is a vane dividing the valve chamber into semicylindrical spaces.

* * * * *